US007370756B2

(12) United States Patent
Bray et al.

(10) Patent No.: US 7,370,756 B2
(45) Date of Patent: May 13, 2008

(54) PACK FOR SMOKING ARTICLES

(75) Inventors: Andrew Jonathan Bray, Southampton (GB); Roy Adrian Stewart-Cox, Southampton (GB); Alan Douglas Tearle, Southampton (GB); Steven Holford, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 453 days.

(21) Appl. No.: 10/507,588

(22) PCT Filed: Mar. 11, 2003

(86) PCT No.: PCT/GB03/01026

§ 371 (c)(1),
(2), (4) Date: Sep. 13, 2004

(87) PCT Pub. No.: WO03/078274

PCT Pub. Date: Sep. 25, 2003

(65) Prior Publication Data

US 2005/0103829 A1 May 19, 2005

(30) Foreign Application Priority Data

Mar. 12, 2002 (GB) ..... 0205697.6

(51) Int. Cl.
*B65D 85/10* (2006.01)

(52) U.S. Cl. ..... 206/268; 206/273; 206/459.5

(58) Field of Classification Search ..... 206/242, 206/265, 268, 271, 273, 459.5; 229/160.1, 229/87.13; D27/189
See application file for complete search history.

(56) References Cited

U.S. PATENT DOCUMENTS

| | | | | |
|---|---|---|---|---|
| 149,889 | A * | 4/1874 | Smith | 229/160.1 |
| 1,735,325 | A * | 11/1929 | Enfant | 229/160.1 |
| 1,877,955 | A * | 9/1932 | Ottinger | 229/87.13 |
| 4,923,059 | A | 5/1990 | Evers et al. | |
| 4,948,038 | A | 8/1990 | Moeller | |
| 5,366,077 | A * | 11/1994 | Pham | 206/268 |
| 5,553,773 | A | 9/1996 | Focke et al. | |
| 5,749,462 | A * | 5/1998 | Houghton | 206/268 |
| 5,845,770 | A * | 12/1998 | James et al. | 206/268 |
| 6,138,823 | A * | 10/2000 | Focke et al. | 206/259 |
| 6,193,060 | B1 * | 2/2001 | Roberts et al. | 206/268 |
| 6,360,943 | B1 * | 3/2002 | Focke et al. | 229/160.1 |
| 6,364,106 | B1 * | 4/2002 | Fagg et al. | 206/268 |
| 6,474,469 | B1 * | 11/2002 | Luton et al. | 206/268 |
| 6,527,166 | B1 | 3/2003 | Focke et al. | |

FOREIGN PATENT DOCUMENTS

| | | |
|---|---|---|
| GB | 2032887 A | 5/1980 |
| GB | 2298414 A | 9/1996 |

* cited by examiner

*Primary Examiner*—Luan K Bui
(74) *Attorney, Agent, or Firm*—Charles I. Sherman; Middleton Reutlinger

(57) ABSTRACT

This invention relates to a smoking article pack. The pack and the inner frame used in combination Therewith provide a substantially increased internal surface area for the printing of graphics and/or indicia in order to provide information to the consumer whilst not substantially increasing the surface area of the blank required to make the body of the pack.

11 Claims, 6 Drawing Sheets

PACK FOR SMOKING ARTICLES

CROSS REFERENCE TO PRIOR APPLICATIONS

This application is a national stage filing (35 U.S.C. 371) of PCT/GB03/01026, filed on Mar. 11, 2003, which claims priority to and benefit of, currently pending, Great Britain Patent Application No. 0205697.6, filed on Mar. 12, 2002.

The present invention relates to a hinged-lid smoking article pack, in particular, but not exclusively, for cigarettes.

As is well known to those skilled in the art, one of the most commonly used cigarette packs is that usually known as the hinged-lid pack (hereinafter referred to as an "HL pack"). The major components of the HL pack are a base, a lid hingedly connected to the base, and an inner frame. It is usual that the standard HL pack has dimensions such that the front and back walls of the pack are of greater width than the side walls thereof.

The inner frame of the HL pack comprises a front wall and side walls and is positioned within the base of the pack such that a portion of the inner frame projects above the base of the pack and is exposed when the HL pack is in an open position. The exposed portion of the inner frame is substantially covered by the front and side walls of the lid portion of the HL pack when the pack is in a closed position.

In order that consumers receive as much information as possible regarding the product and the brand of smoking articles they choose, it is advantageous that the surface area available to carry such information is maximised.

To date, methods of providing information and advertising have included coupons within or attached to packs. However, the use of coupons involves use of more material than is the case in respect of a standard pack and added complications in pack manufacture.

The present invention has as an aim the provision of a smoking article pack having substantially increased advertising space whilst not substantially increasing the amount of material needed to manufacture the pack, or, indeed, any increase in the amount of material whatsoever.

A further object of the present invention is, whilst providing for increased advertising space, to provide an HL pack for smoking articles having an outward appearance that is not substantially changed from that of a standard hinged-lid pack. The effect may be readily achieved of an outward appearance which is virtually identical to that of a standard HL pack.

In a first aspect thereof, the present invention provides a smoking article hinged-lid pack wherein an angle $\Phi$ is less than 30°.

When referred to herein, angle $\Phi$ shall be taken as being the angle formed between two straight lines defining, or bounding, $\Phi$, one of which straight lines represents the plane of the rear of the base portion of the pack. The other straight line is, essentially, that straight line which passes through or interconnects the hinge line of the HL pack and the point which represents the upper edge of the front wall of the base portion. It will usually be the case that the latter straight line will be the line describing the upper inclined edge of the base side wall(s).

According to a first embodiment of the present invention the ratio of the shortest length of the inner frame, between the top edge of the base front wall and the lowest point of the upper edge of the inner frame, to the shortest length of the base front wall, hereinafter referred to as ratio A:B, is greater than that of a standard HL pack.

Preferably the ratio of the shortest length of the inner frame, between the top edge of the base front wall and the lowest point of the upper edge of the inner frame, to the shortest length of the base front wall, that is ratio A:B, is in the range of about 0.15:1 to about 15.0:1.

Suitably the ratio of the shortest length of the inner frame, between the top edge of the base front wall and the lowest point of the upper edge of the inner frame, to the shortest length of the base front wall, is in the range of about 0.15:1 to about 7:1. Preferably the ratio is between about 0.25:1 to about 1.1:1, and is even more preferably in the range of about 0.3:1 to about 1:1.

It will be readily apparent to those skilled in the art that an increase in ratio A:B may be achieved, for example, by decreasing dimension B alone.

According to a second embodiment of the present invention the ratio of the shortest length of the lid front wall, to the shortest length of the base front wall, hereinafter referred to as ratio C:B, is greater than that of a standard HL pack.

Preferably the ratio of the shortest length of the lid front wall, to the shortest length of the base front wall, that is ratio C:B, is in the range of about 35:65 to about 95:5.

Suitably the ratio of the shortest length of the lid front wall to the shortest length of the base front wall perpendicular is in the range of about 35:65 to about 90:10. Preferably the ratio is in the range of about 35:65 to about 75:25 and even more preferably the ratio is in the range of about 40:60 to about 60:40.

It will be readily apparent to those skilled in the art that an increase in ratio C:B may be achieved by, for example, decreasing B alone or, alternatively, by decreasing dimension B and simultaneously increasing dimension C. Preferably an increase in ratio C:B is provided by a reduction in dimension B and a proportional increase in dimension C. It is much by preference that the reduction in dimension B is equal to the increase in dimension C.

The first and second embodiments of the present invention may be used individually or in combination.

According to a second aspect of the present invention there is provided a HL pack for smoking articles wherein the ratio of the shortest length of the inner frame, between the top edge of the base front wall and the lowest point of the upper edge of the inner frame, to the shortest length of the base front wall, hereinafter referred to as ratio A:B, is greater than that of a standard HL pack, the increase in ratio A:B being provided by an increase in dimension A alone.

Preferably in both aspects of the invention the lengths of the inner frame, lid front wall and base front wall are measured perpendicular to the bottom wall, and more particularly the bottom front wall fold line.

In accordance with the first and second aspects of the present invention, it is much by preference that when the pack is in a closed position, the lower edge of the lid front wall is in abutment with the upper edge of the base front wall. The line of abutment of the lower edge of the lid front wall and the upper edge of the base front wall may be substantially parallel to the bottom wall of the pack. In this embodiment of the present invention the vertical height of the pack, F, is equal to the sum of the lengths of the lid front wall, C, and the base front wall, B, which lengths C and B are measured perpendicular to the bottom wall of the HL pack.

Alternatively, when the pack is in a closed position, the lower edge of the lid front wall is in an other than abutting relation with the upper edge of the base front wall. In this further embodiment of the present invention the vertical height of the pack, F, is greater than the sum of the lengths of the lid front wall, C, and the base front wall, B, which lengths B and C are measured perpendicular to the bottom wall of the HL pack.

In accordance with a further alternative embodiment of the present invention, when the pack is in a closed position, the lower edge of the lid front wall is in partial abutment with the upper edge of the base front wall. The line of abutment of the lower edge of the lid front wall and the upper edge of the base front wall may be substantially parallel to the bottom wall of the pack.

That portion of the lower edge of the lid front wall that is in other than abutting relation with the base front wall may overlap a portion of the base front wall or alternatively may be spaced apart from the base front wall such that a portion of the inner frame is exposed when the pack is in a closed position.

The inner frame between the top edge of the base front wall and the upper edge of the inner frame may be printed with indicia and/or graphics only visible to the consumer when the pack is in an open position.

Alternatively, or in addition, the inward facing surface of the lid front wall may be printed with indicia and/or graphics only visible to the consumer when the pack is in an open position.

Suitably, the preferred ratios mentioned herein may be selected in order to provide the required surface area for graphics and/or indicia.

Advantageously, in the closed position, the smoking article pack of the present invention has the appearance of a hinged lid pack for smoking articles.

The present invention further provides a smoking article hinged lid pack blank for forming the body of a pack according to the present invention.

Preferably the surface area of the smoking article HL pack blank (excluding the inner frame) is substantially similar to that of a standard hinged lid pack blank. The surface area of a standard hinged lid pack (excluding the inner frame) when referred to herein shall be taken as being about 21685 $mm^2$.

Advantageously, the surface area of the smoking article pack blank of the present invention is in the range of about 21675 $mm^2$ to about 21695 $mm^2$.

Preferably the surface area of the pack blank is in the range of about 21680 $mm^2$ to about 21685 $mm^2$.

In order that the invention may be easily understood and readily carried into effect, reference will now be made, by way of example, to the accompanying diagrammatic drawings in which.

Figure 1:
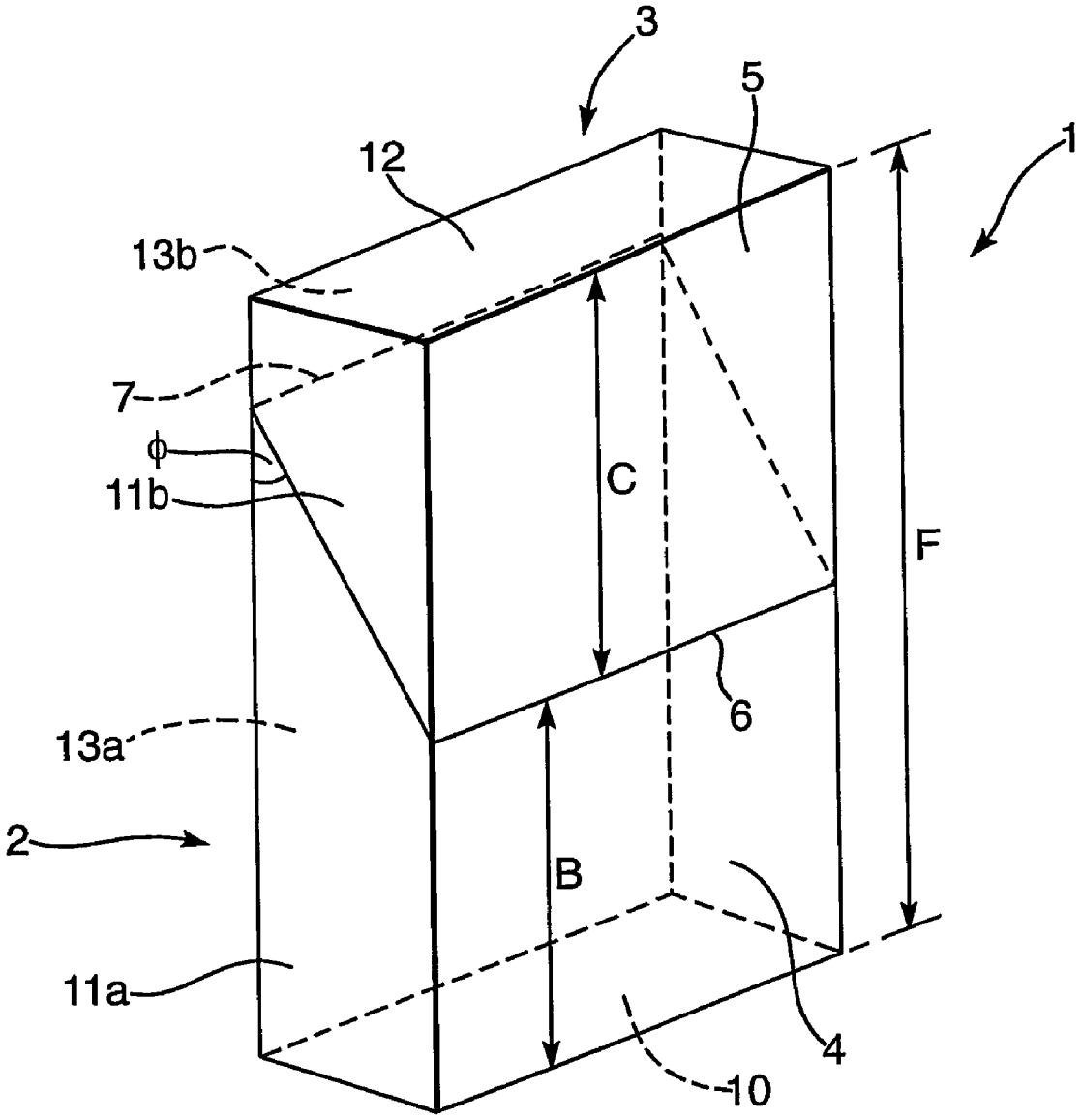
FIG. 1 shows a pack according to a first aspect of the present invention, the pack being in a closed position.

FIG. 1 shows a smoking article HL pack 1 in a closed position. The pack 1 comprises a base 2 and a lid 3, the base having a front wall 4, side walls 11*a*, bottom wall 10 and back wall 13*a*. The lid 3 has a top wall 12, a front wall 5, side walls 11*b* and back wall 13*b*. The base back wall 13*a* and the lid back wall 13*b* are connected along hinge line 7. Hinge line 7 is parallel to top wall 12 and bottom wall 10. The base front wall 4 and the lid front wall 5 abut one another at a line of abutment 6 when the pack is in the closed position as shown in FIG. 1. When the base front wall 4 and the lid front wall 5 abut one another, as is shown in FIG. 1, the vertical height of the pack (F) is equal to the sum of the shortest length (C) of lid front wall 5 and the shortest length (B) of the base front wall 4. FIG. 1 shows a pack 1 in accordance with a first aspect of the present invention, the pack 1 having an angle Φ, which angle Φ is formed between two straight lines, one of which straight lines represents the plane of base back wall 13*a*. The other straight line is that straight line which interconnects the hinge line 7 of the HL pack 1 and the point which represents the upper edge of base front wall 4.

According to one embodiment of the invention, the ratio of the shortest length (C) of the lid front wall 5, perpendicular to the bottom wall 10, to, the shortest length (B) of the base front wall 4 perpendicular to the bottom wall 10, is such that there is provided an increased internal surface area for the printing of indicia and/or graphics. The internal surface area may be provided by means of an inner frame, such as that shown in FIGS. 5 and 6. Alternatively, or in addition, the increased internal surface area may be provided by means of the inward facing surface of the lid front wall 5.

Figure 2:
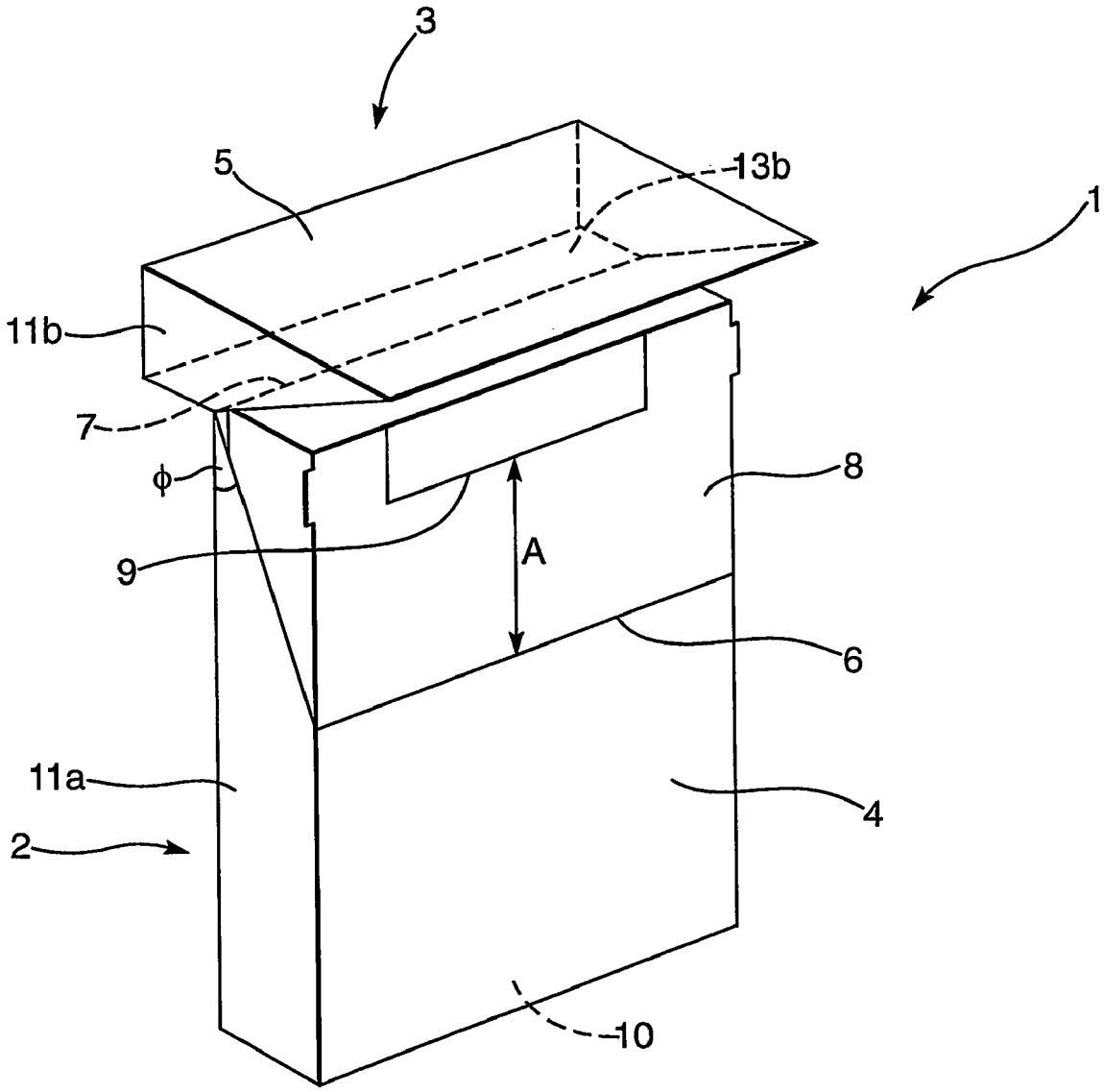
FIG. 2 shows a pack according to a first aspect of the present invention, the pack being in an open position.

FIG. 2 shows a smoking article HL pack 1 according to one embodiment of the present invention in an open position. In FIG. 2 the same reference numerals are used as in FIG. 1 denoting the same features. In this embodiment, lid back wall 13*b* and base back wall 13*a* (not shown) are hinged around hinge line 7 so as to open the pack 1 and expose inner frame 8. According to one aspect of the invention, the shortest length (A) of the inner frame 8, perpendicular to base bottom wall 10, between the line of abutment 6 and the lowest point of the upper edge of the inner frame 9, is such that the exposed surface of the inner frame 8 may be printed with indicia and/or graphic art.

Alternatively, or in addition, the inward facing surface of lid front wall 5 may be printed with indicia and/or graphic art.

Figure 3:
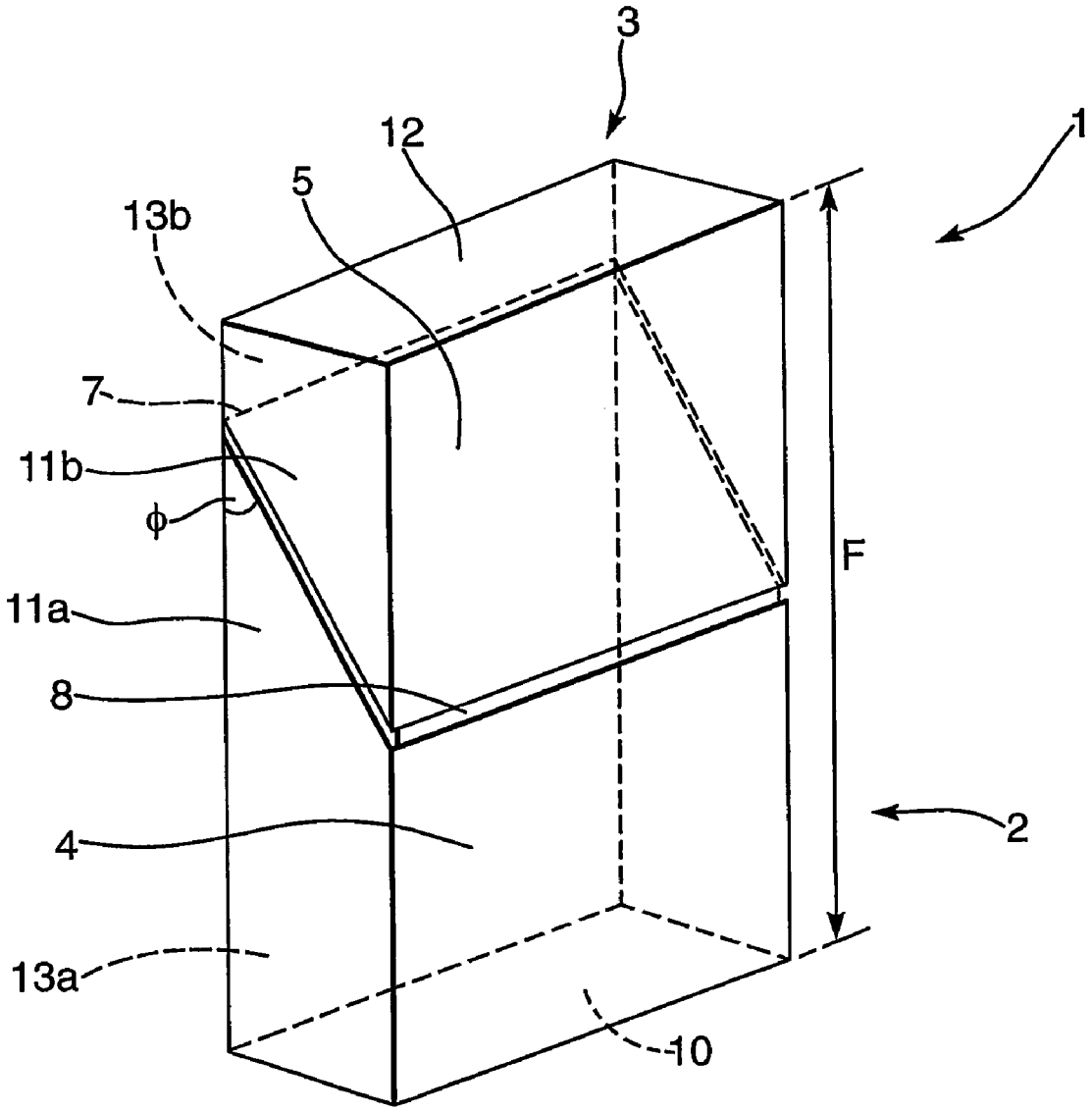
FIG. 3 shows a pack according to an alternative embodiment of the present invention, the pack being in a closed position.
Figure 7:
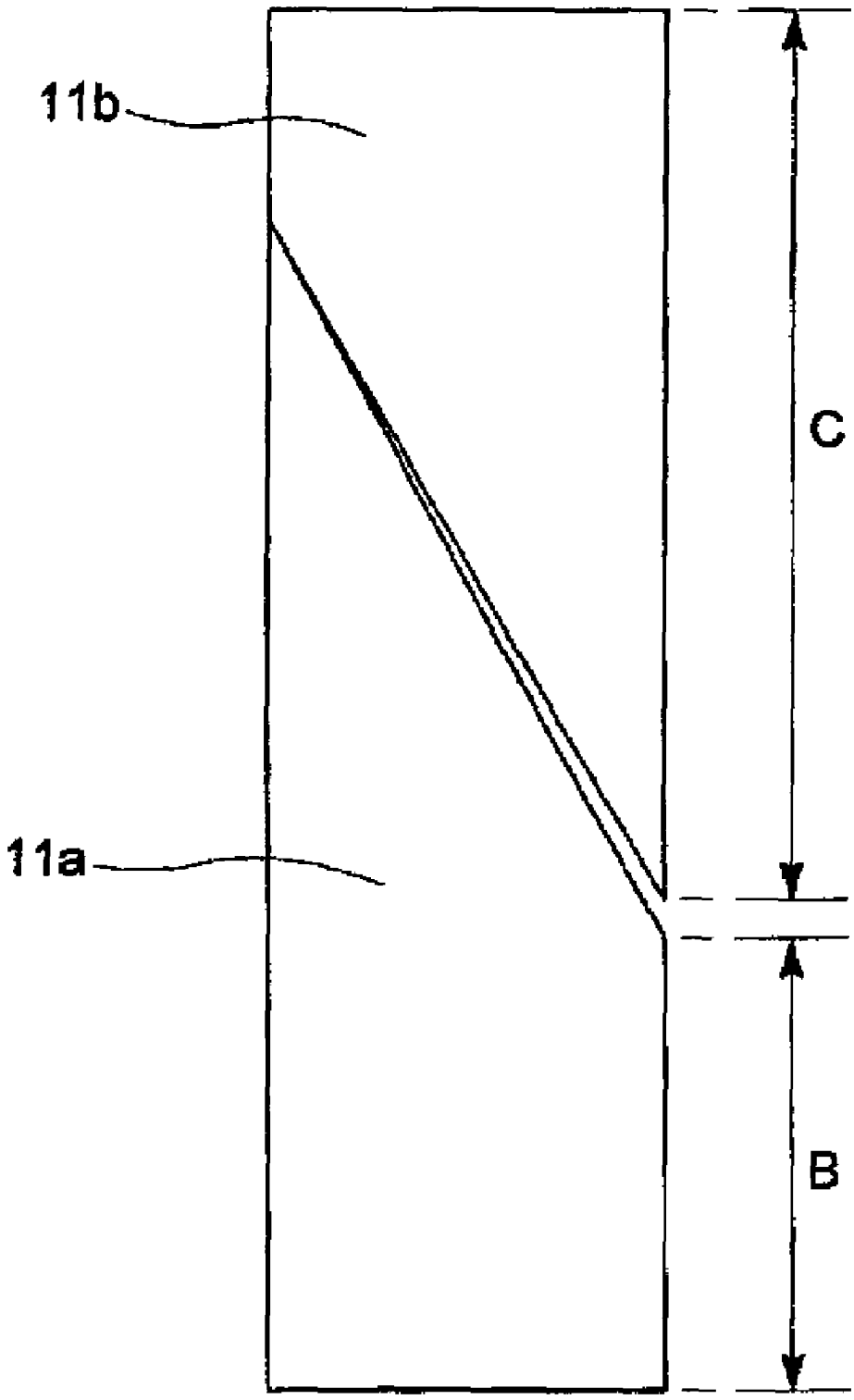
FIG. 7 shows a side view of the pack of FIG. 3, which pack is shown without an inner frame.

FIGS. 3 and 7 show a smoking article HL pack 1 according to an alternative embodiment of the present invention in a closed position. In FIG. 3 the same reference numerals are used as in earlier Figures denoting the same features. In this embodiment the lower edge of lid front wall 5 is spaced apart from base front wall 4 and a portion of the inner frame 8 is exposed when the pack is in a closed position. In the embodiment shown in FIG. 3 and FIG. 7, the vertical height of the pack (F) is greater than the sum of the shortest length (C) of lid front wall 5 and the shortest length (B) of the base front wall 4.

In an alternative arrangement, a portion of the lower edge of lid front wall 5 may be spaced apart from base front wall 4 and a portion of the inner frame 8 is exposed when the pack is in the closed position.

In a further alternative (not shown) a portion, or all of the lower edge of lid front wall 5 may overlap a portion of the base front wall 4 when the pack is in a closed position.

Figure 4:
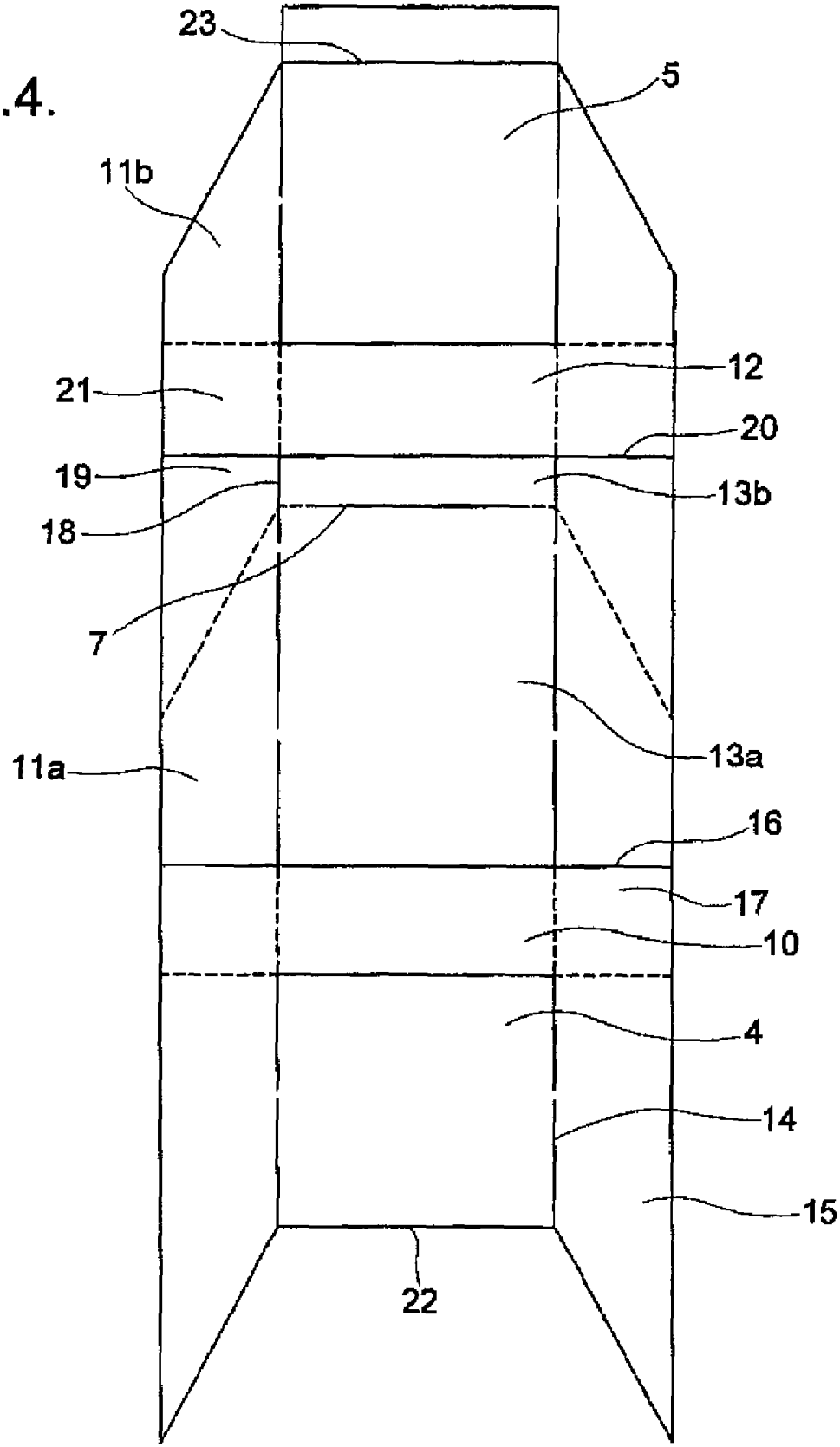
FIG. 4 shows a pack blank for the body of a pack according to the invention of FIGS. 1 and 2.

FIG. 4 shows a pack blank for the body of a pack 1 according to the invention of FIGS. 1 and 2. Like numerals have been assigned to the like parts of FIGS. 1 and 2.

The blank comprises a base front wall 4, a bottom wall 10, base back wall 13*a*, lid back wall 13*b*, top wall 12 and lid front wall 5. Base front wall 4 has side margins 14 and side flaps 15 depending therefrom. When the pack is erected, side flaps 15 rest inside side walls 11*a* and may be glued thereto.

Side walls 11*a* have bottom margins 16 and base wall inner flaps 17 depending therefrom. When the pack is erected, base wall inner flaps 17 rest inside bottom wall 10 and may be secured thereto. Lid back wall 13*b* has side margins 18 and side flaps 19. Side flaps 19 have top margins 20 and top wall side flaps 21 depending therefrom. When the pack is erected side flaps 19 rest inside, and are secured to, lid side walls 11*b*. In addition, top wall side flaps rest inside and may be secured to top wall 12.

In FIG. 4 fold lines are shown as solid lines and lines of cut are shown as dashed lines.

In one embodiment of the present invention, when the pack is erected and in a closed position, the top edge 22 of front base wall 4 and the lower edge 23 of front lid wall 5 abut one another at a line of abutment 6 (not shown).

Alternatively, top edge 22 of front base wall 4 and lower edge 23 of front lid wall 5 may be spaced apart when the pack is erected and in a closed position.

The surface area of the blank of FIG. 4 is not substantially increased over that of a standard hinged lid pack blank (excluding the inner frame). The surface area of a standard hinged lid pack blank (excluding the inner frame) is about 21685 $mm^2$.

Figure 5:
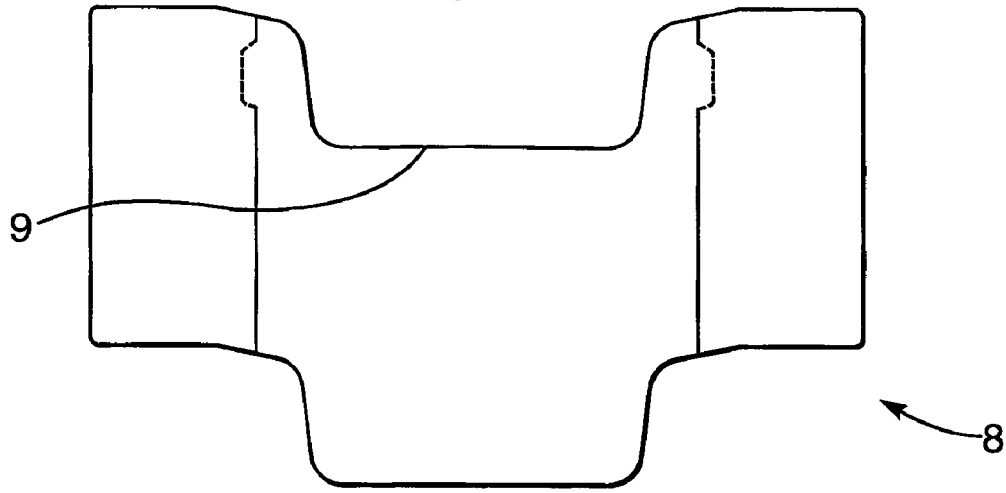
FIGS. 5 and 6 show an inner frame used in conjunction with the body of a pack of the present invention.
Figure 6:
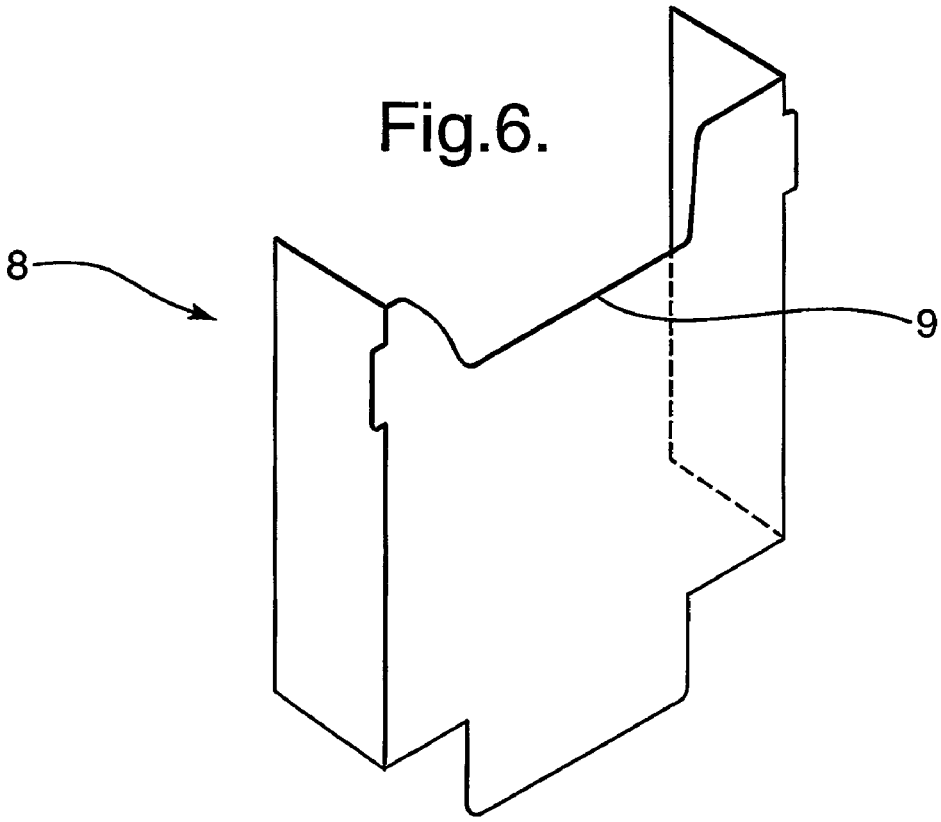

FIGS. 5 and 6 show an inner frame 8 to be used in conjunction with the body of a pack 1 of the present invention. The lowest point of the upper edge of the inner frame is shown as 9 in FIGS. 5 and 6.

The invention claimed is:

1. A smoking article hinged-lid pack having increased space for displaying graphics or indicia on the front wall of the inner frame and on the inward facing surface of the front wall of the lid comprising:

a base comprising a base front wall having a base front wall upper edge, a base back wall, two base side walls each respectively interconnecting adjacent side edges of said base front wall and said base back wall, and a bottom wall interconnecting all lower edges of said base front wall, said base back wall, and said two base side walls;

a lid comprising a lid front wall, a lid back wall, two lid side walls each respectively interconnecting adjacent side edges of said lid front wall and said lid back wall, and a top wall interconnecting all upper edges of said lid front wall, said lid back wall, and said two lid side walls;

said lid being hingedly connected to said base along a hinge line running across said base back wall and said lid back wall; and wherein the angle between each side edge of said base back wall and the upper edge of the base side wall in contact with said each side edge of said base back wall is less than 30°; and wherein the lower edges of each of said two lid side walls run parallel to adjacent upper edges of the base side walls when said lid is in a closed position relative to said base; and wherein the lower edge of said lid front wall runs parallel to the lower edge of said base front wall;

said hinged-lid pack having an inner frame with a continuous front wall for the display of indicia or graphics which extends to the upper edge of said inner frame and beyond said base front wall upper edge; and, wherein a ratio of a shortest length of said front wall of said inner frame, between the upper edge of said base front wall and a lowest point of said upper edge of said inner frame, to the shortest length of said base front wall, between said upper edge of said base front wall and the lower edge of said base front wall, is in the range of about 0.3:1 to about 15.0:1.

2. A smoking article hinged-lid pack according to claim 1, wherein the ratio of the shortest length of said lid front wall between the upper edge of said lid front wall and the lower edge of said lid front wall to the shortest length of said base front wall between the upper edge of said base front wall and the lower edge of said base front wall is in the range of about 40:60 to about 60:40.

3. A smoking article hinged-lid pack according to claim 1, wherein when said hinged-lid pack is in a closed position, said lower edge of a lid front wall is in abutment with said upper edge of said base front wall.

4. A smoking article hinged-lid pack according to claim 1, wherein when said hinged-lid pack is in an open position, a lower edge of a lid front wall is in an other than abutting relation with said upper edge of said base front wall.

5. A smoking article hinged-lid pack according to claim 1, wherein when said hinged-lid pack is in a closed position, said lower edge of said lid front wall is in partial abutment with said upper edge of said base front wall.

6. A smoking article hinged-lid pack according to claim 1 having an inner frame with a front wall terminating at an upper edge, wherein said inner frame, between the upper edge of said base front wall and said upper edge of said inner frame is printed with indicia and/or graphics.

7. A smoking article hinged-lid pack according to claim 1, wherein an inward facing surface of said lid front wall is printed with indicia and/or graphics.

8. A smoking article hinged-lid pack according to claim 1, wherein each of said shortest lengths are measured perpendicular a bottom wall.

9. A smoking article hinged-lid pack according to claim 8, wherein the shortest lengths are measured perpendicular to a bottom wall front fold line.

10. A smoking article hinged-lid pack according to claim 1, wherein said pack is formed from a pack blank having a surface area in the range of about 21675 $mm^2$ to about 21695 $mm^2$.

11. A smoking article hinged-lid pack blank according to claim 1, wherein said surface area of said pack is in the range of about 21680 $mm^2$ to about 21685 $mm^2$.

* * * * *